US006242105B1

(12) United States Patent
Joseph et al.

(10) Patent No.: US 6,242,105 B1
(45) **Date of Patent: *Jun. 5, 2001**

(54) PROCESS FOR COATING METALLIC PARTS AND METALLIC PRODUCT THUS COATED

(75) Inventors: Alice Joseph, Schiltigheim; Alain Le Marchand, Reichstett; Pierre-Noël Rollin, Strasbourg, all of (FR)

(73) Assignee: Ateliers Reunis Caddie, Strasbourg-Schiltigheim (FR)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/200,951

(22) Filed: Feb. 23, 1994

(51) Int. Cl.[7] ..... C23C 28/00

(52) U.S. Cl. ..... 428/598; 205/149; 205/196; 205/224; 205/305; 428/623; 428/626; 428/658; 428/659

(58) Field of Search ..... 205/196, 155, 205/141, 50, 149, 224, 305; 428/598, 623, 626, 658, 659; 280/47.34, DIG. 4

(56) References Cited

U.S. PATENT DOCUMENTS

| | | | | |
|---|---|---|---|---|
| 3,891,471 | | 6/1975 | Summers et al. | 148/248 |
| 3,953,644 | | 4/1976 | Camelon et al. | 428/220 |
| 4,251,582 | | 2/1981 | Bernier et al. | 428/99 |
| 4,401,523 | * | 8/1983 | Avellone | 205/96 |
| 4,407,899 | * | 10/1983 | Hara et al. | 428/626 |
| 4,541,903 | * | 9/1985 | Kyono et al. | 205/141 |

FOREIGN PATENT DOCUMENTS 2 696 371 4/1994 (FR) .

OTHER PUBLICATIONS

H. Silman et al, *Protective and Decorative Coatings for Metals*, Finishing Publications Ltd., Teddington, Middlesex, England, 1978, Month of publication not available, pp 416–435.*

* cited by examiner

*Primary Examiner*—Kathryn Gorgos
*Assistant Examiner*—William T. Leader
(74) *Attorney, Agent, or Firm*—Pennie & Edmonds LLP

(57) ABSTRACT

Before the application of an external coating having a base of polyester or epoxy resin, or of a mixture of the two by spraying with an electrostatic spray gun, the parts to be coated are subjected to an initial zinc coating treatment by electrolytic process and a layer of an acrylic paint is applied to the zinc coating and polymerized to define a bonding sublayer between the metal and the external coating.

18 Claims, No Drawings

PROCESS FOR COATING METALLIC PARTS AND METALLIC PRODUCT THUS COATED

FIELD OF THE INVENTION

This invention relates to the processes for covering metallic parts or structures with a coating consisting of a thermosetting powder, having a base of polyester or epoxy resin or a mixture of the two, as well as the metallic products thus coated.

BACKGROUND OF THE INVENTION

The addition of such a coating has in particular as its object to improve the esthetic appearance of the corresponding parts and to assure their protection against the dangers of corrosion. For this double purpose, it is common to provide such a coating on many metallic parts or structures, for example on supermarket carts, carrying baskets, shelving elements . . . . The application of the coating thus provided is performed by spraying of the thermosetting powder, with an electrostatic spray gun, on the parts to be covered, then passing of the latter through a furnace heated to a temperature on the order of 220° C. to assure the polymerization of the coating.

However, the coating thus applied has the drawback of exhibiting an insufficient resistance against impacts as well as to abrasion. Here, therefore, it is a particularly bothersome drawback when such a coating is provided on objects that can undergo impacts or friction as is the case, for example, for supermarket carts, carrying baskets, etc.

Furthermore, this type of coating exhibits an insufficient resistance against the dangers of corrosion under the action of chemical products or even simply of atmospheric agents.

SUMMARY OF THE INVENTION

For the above reasons, the present invention has an object a process for covering metallic parts or structures which is designed so as to improve appreciably the conditions for adherence of the coating of the type in question and consequently its resistance to impacts and its resistance to abrasion.

For this purpose, this process is characterized in that before the spraying of the thermosetting powder intended to constitute the external coating, the following two operations are performed successively on the parts to be covered:

a) initial zinc coating treatment for electrolytic process, b) application of a layer of a paint, then after drying or baking or polymerization of this coating of paint, this intermediate coating being able to serve as a bonding sublayer between the metal and the external coating having a base of polyester resin, epoxy resin, or a mixture of the two.

According to other characteristics of the invention:

the thickness of the coating is between 2 and 30 micrometers and preferably between 5 and 25 micrometers, the application of the layer of an acrylic paint is performed by dipping, by dipping of the parts in a bath of said paint, the application of the layer of an acrylic paint is performed by spraying, the polymerization of the acrylic paint is performed in a furnace.

The invention also has as its object a metallic product, particularly assembled by welding of wires, coated by a coating process.

DETAILED DESCRIPTION OF THE INVENTION

The sublayer coating has the advantage not only of assuring a very strong bonding of the external coating with the corresponding metallic part but also of improving in considerable proportions the resistance of the external coating with regard to impacts and the dangers of abrasion. This is due in particular to the fact that this intermediate layer which is clearly not so hard as the zinc-coated metal alone, serves in a way as a damping buffer between the external coating and the carrying metallic part. Thus, in case of impact, the external coating can more easily withstand the dangers of cracking, breaking or stripping that exist in the case of a direct application of such a coating on a metallic part.

Generally, the advantages of the parts having a coating produced by the process according to the invention essentially relate to the following three points:

a) excellent resistance of the external coating with regard to impacts and to abrasion, for the reasons previously indicated.

b) very strong bonding of the external coating with the coated parts and this, because of the quality of the bonding of this coating with the intermediate acrylic paint which itself exhibits a very strong bonding with the previously zinc-coated metallic parts.

c) very good resistance of the whole against the dangers of corrosion resulting from chemical products as well as from the action of the atmospheric agents.

These advantages have, moreover, been shown by comparative tests which have been performed with three separate batches of the metallic parts comprising respectively: the direct application of an external coating of the type in question, the application of this coating on parts having only received a prior zinc-coating treatment and the application of such a coating on parts having previously undergone both a zinc-coating treatment and their coating with an acrylic paint. Actually, these comparative tests demonstrated that the parts of this last batch exhibit very clear advantages on these various points compared with the parts of the other two batches.

To use the process according to the invention, the following operations are performed successively:

1) the parts to be covered are first of all coated with a zinc coating by electrolytic process and this, after having undergone the necessary prior treatments such as pickling, degreasing, etc.

2) the zinc-coated parts are provided with a coating of acrylic paint, and this by dipping in a bath of such a paint. Then these parts are transferred into a furnace heated to a temperature on the order of 220° C. to assure the polymerization of the acrylic paint.

3) the parts to be covered then receive their external coating by spraying of the latter by means of an electrostatic spray gun. This external coating consists of a thermosetting powder having a base of polyester resin or epoxy resin or a mixture of the two. Finally, the parts are again transferred into a furnace heated to a temperature on the order of 220° C. to assure the polymerization of this external coating.

The composition of the acrylic paint used as an intermediate layer can, for example, be the following composition:

BUTANOL 13.4%

XYLENE 35%

Preferably so that the intermediate layer thus constituted can effectively play its role, its thickness is between 5 and 25 microns, if the thickness of the external coating is itself on the order of 50 to 200 microns.

In any case, the intermediate layer has a hardness less than that of the zinc-coated metal so that it is a good agent of sufficient bonding to prevent dangers of cracking, breaking or stripping of the coating, when the corresponding parts are subjected to impacts or to an abrasion.

The external coating can be produced by means of thermosetting powders such as the powder marketed under the trademark "POLYDROX" by the Societe Industrielle de Voisins (69). But here it is only an indicative example because it is possible to use many other types of composition of thermosetting powders for coating, having a base of polyester resin or epoxy resin, or a mixture of the two.

What is claimed is:

1. The improvement in the process for coating metallic structures consisting of assembled wires, wherein an external coating is applied by electrostatic spraying of a thermosetting powder of a polyester resin, an epoxy resin or a mixture of the two, and the external coating is then polymerized in a furnace; the improvement wherein, before the spraying of said powder, the method includes:

a) applying an initial coating consisting of zinc to the metallic structure by an electrolytic process;

b) applying a layer consisting essentially of an acrylic coating onto the zinc coating; and c) drying the layer of acrylic coating to define an intermediate acrylic coating serving as a bonding sublayer between said metallic structure and said external coating onto which sublayer said powder is sprayed, wherein the metallic structure comprises a cart.

2. The coating process of claim 1 wherein:

a) the acrylic coating is polymerized in a furnace.

3. Coating process according to claim 2, wherein:

a) the thickness of the intermediate acrylic coating is between about 2 and 30 microns.

4. Coating process according to claim 3, wherein:

a) the thickness of the intermediate acrylic coating is between about 5 and 25 microns; and b) the thickness of said external coating is between about 50 and 200 microns.

5. Coating process according to claim 1, wherein:

a) the application of the layer of the acrylic coating is performed by dipping of the parts or structures in a bath of said coating.

6. Coating process according to claim 1, wherein:

a) the application of the layer of acrylic coating is performed by spraying.

7. The improvement in a coated metallic product of an assembled wire substructure having a metallic surface coated with an external coating of a polyester resin, epoxy resin, or a mixture of the two; the improvement wherein:

a bonding sublayer is disposed between said metallic surface and said external coating and adhered to both said metallic surface and said external coating, said sublayer comprising:

a coating consisting of zinc adhered to said metallic surface;

a layer of soft coating material consisting of a polymerized acrylic coating adhered to said zinc coating and to said external coating wherein said layer of soft material acts as a damping buffer between said external coating and said zinc coating adhered to said metallic surface;

wherein said substructure is defined by an assemblage of metal wires welded together; and wherein the coated metallic product comprises a cart.

8. The metallic product according to claim 7 wherein:

a) said acrylic coating contains about 13% butanol and 35% xylene.

9. The metallic product according to claim 8 wherein:

a) the acrylic coating has a thickness of between about 5 and 25 microns; and b) said external coating has a thickness of between about 50 and 200 microns.

10. A cart of a coated, assembled wire product having a metallic surface which comprises:

a coating consisting of zinc adhered to the metallic surface;

a layer of soft coating material consisting of a polymerized acrylic coating adhered to the zinc coating and to an external coating, wherein the layer of soft coating material is sufficiently soft to act as a dampening buffer between the external coating and the zinc coating, wherein the zinc coating and the layer of soft coating material together form a bonding sublayer disposed between the metallic surface and the external coating so as to facilitate adherence of the sublayer to both the metallic surface and the external coating; and an external coating of a polyester resin, epoxy resin, or a mixture of the two, wherein the cart has an assemblage of metal wires welded together.

11. The cart of claim 10, wherein the acrylic coating has a thickness from about 5 to 25 microns; and the external coating has a thickness of about 50 to 200 microns.

12. The cart of claim 10, wherein the assembled wires are welded and the coating layers are disposed thereon.

13. The cart of claim 10, wherein the layer of soft acrylic coating material has a hardness less than the hardness of the zinc coated metal.

14. A process for coating a cart having an assembled metallic wire structure which comprises:

applying an initial coating of zinc to the metallic structure by an electrolytic process;

applying a layer consisting essentially of an acrylic coating onto the zinc coating;

drying the layer of acrylic coating sufficiently to define an intermediate acrylic coating with the zinc coating which together serve as a bonding sublayer between the metallic structure and an external coating;

electrostatically spraying a thermosetting powder of a polyester resin, an epoxy resin, or a mixture of the two onto the bonding sublayer; and polymerizing the external coating in a furnace so as to sufficiently dry the external coating, wherein the bonding sublayer facilitates adherence of the external coating to the assembled metallic wire structure.

15. The process of claim 14, wherein the layer consisting essentially of acrylic is applied to a thickness of about 5 to 25 microns and wherein the powder is sprayed so as to provide an external coating thickness of about 50 to 200 microns.

16. The process of claim 15, wherein the acrylic coating is applied by spraying.

17. The process of claim 14, wherein the acrylic coating is applied by dipping the zinc-coated structure in a bath of acrylic coating material.

18. A cart which comprises:

a coating consisting of zinc adhered to a metallic surface;

a layer of soft coating material consisting of a polymerized acrylic coating adhered to the zinc coating and to an external coating, wherein the layer of soft coating material is sufficiently soft to act as a dampening buffer between the external coating and the zinc coating, wherein the zinc coating and the layer of soft coating material together form a bonding sublayer disposed between the metallic surface and the external coating so as to facilitate adherence of the sublayer to both the metallic surface and the external coating; and an external coating comprising a polyester resin, wherein the cart has an assemblage of metal wires welded together.

* * * * *